US008105055B2

(12) United States Patent
Small

(10) Patent No.: US 8,105,055 B2
(45) Date of Patent: Jan. 31, 2012

(54) SUCTION MANIFOLD MOUNTING FOR A FLUID END FOR A HIGH-PRESSURE PUMP

(75) Inventor: Tony M. Small, Mansfield, TX (US)

(73) Assignee: Fiac Tech Services, LLC, Cisco, TX (US)

( * ) Notice: Subject to any disclaimer, the term of this patent is extended or adjusted under 35 U.S.C. 154(b) by 326 days.

(21) Appl. No.: 12/487,401

(22) Filed: Jun. 18, 2009

(65) Prior Publication Data

US 2010/0322803 A1 Dec. 23, 2010

(51) Int. Cl.
*F04B 39/00* (2006.01)
*F04B 53/10* (2006.01)

(52) U.S. Cl. ..... 417/454; 403/321; 417/569

(58) Field of Classification Search ..... 417/360, 417/569–571, 454; 403/321, 322.1
See application file for complete search history.

(56) References Cited

U.S. PATENT DOCUMENTS 4,333,729 A * 6/1982 Marugg ..... 417/313
4,553,298 A * 11/1985 Grable ..... 29/888.02
4,878,815 A * 11/1989 Stachowiak ..... 417/63
5,284,399 A * 2/1994 Brustle et al. ..... 403/199
5,678,798 A * 10/1997 Little ..... 248/289.11
5,846,056 A 12/1998 Dhindsa et al.
7,335,002 B2 * 2/2008 Vicars ..... 417/360
7,341,435 B2 3/2008 Vicars
2004/0161351 A1 * 8/2004 Forrest ..... 417/567

FOREIGN PATENT DOCUMENTS

EP 0317716 5/1989
WO WO 2005100795 10/2005

* cited by examiner

*Primary Examiner* — Charles Freay
(74) *Attorney, Agent, or Firm* — Claude E. Cooke, Jr.; John J. Love; Cooke Law Firm

(57) ABSTRACT

A suction manifold mounting for a fluid end of a high pressure pump having a frame assembly. The fluid end has a body forging with a detachable suction manifold plate. The plate is pivotally attached at opposed ends to a pair of swivel arms through a cooperating pair of yoke limbs. The swivel arms are rigidly affixed to the frame member. When attachment bolts are removed from the manifold plate, the plate may pivot from a first closed position wherein the mounting holes in the plate are aligned with mounting holes in the forging to a second open position.

7 Claims, 5 Drawing Sheets

SUCTION MANIFOLD MOUNTING FOR A FLUID END FOR A HIGH-PRESSURE PUMP

FIELD OF THE INVENTION

This invention relates to fluid ends of high pressure pumps. More particularly, the invention relates to an improved suction manifold mounting system for such fluid ends.

BACKGROUND OF THE INVENTION

High pressure pumps are utilized during hydraulic fracturing in oil and gas operations. U.S. Pat. Nos. 5,846,056; 7,335,002; and 7,341,435 describe such pumps and, particularly, the fluid end of such pumps. These fluid ends are prone to damage as the result of abrasive erosion caused by the fluids transferred through the pump. Constant maintenance is required to keep pump efficiency at an acceptable level. This maintenance results in extended periods of downtime of the pump for disassembly, parts replacement, and reassembly. Thus, reducing downtime may yield significant economic advantages to operators.

One of the time consuming steps in the repair operation is the removal and replacement of the suction manifold in order to gain access to the suction valves. The suction manifold on the fluid end of high pressure pumps are awkwardly shaped and extremely heavy. They generally require the use of special tools and rigging to move them from the bottom side of the fluid end forging. The present invention provides a structural mechanism for ensuring rapid alignment of the suction manifold with the fluid end body forging while improving the safety of the process.

U.S. Pat. Nos. 7,335,002 and 7,341,435 disclose and illustrate one method of gaining access to the suction valves for servicing (U.S. Pat. No. 7,341,435, Col. 3, lines 53-62; Col. 4, lines 67-Col. 5, line 2; and U.S. Pat. No. 7,335,002 (Col. 3, lines 53-63; Col. 4, lines 58-59). It has been found that such an arrangement and method continues to require considerable time to align the mounting bolt holes in the heavy suction manifold with the suction manifold mounting holes in the fluid end forging. The movement of the suction manifold about the pivot pins described in the above identified patents results in a dropping, vertical displacement of the manifold about the pivot pins rather than a preferred direct rotational displacement as will be described below.

SUMMARY OF THE INVENTION

DETAILED DESCRIPTION OF THE PREFERRED EMBODIMENT

Figure 1:
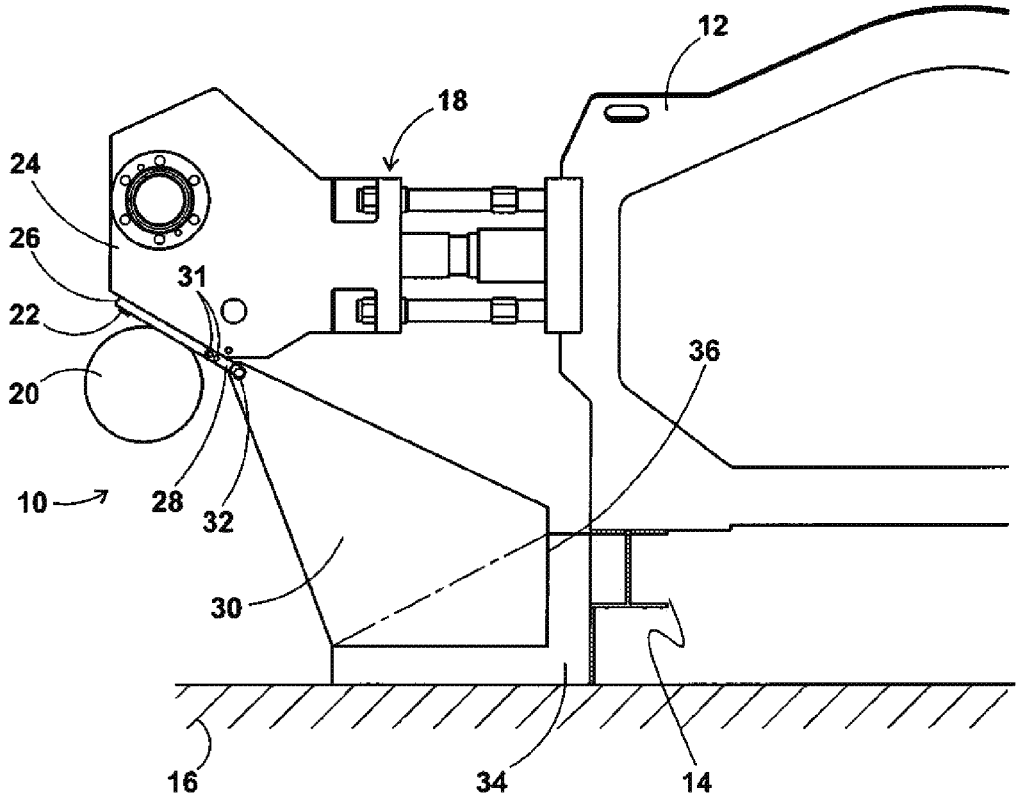
FIG. 1 is a left side elevation view of a high pressure pump showing an embodiment of the suction manifold mounting of the present invention in the closed position.

Referring now to the Figures, the suction manifold mounting system in accordance with the present invention is shown at 10 in the closed position in FIG. 1. A high pressure pump power end 12 is mounted to a pump frame 14 which may be supported on a mobile trailer 16. A fluid end 18 is operatively attached to the power end 12 so as to provide a source of high pressure fluid for injection into an oil or gas well during a standard hydraulic fracting operation.

A suction manifold 20 is mounted by mounting bolts 22 to the fluid end forging 24. Bolts 22 extend through mounting holes (seen in FIG. 3) in the manifold mounting plate 26 into manifold mounting holes in the forging 24 to secure the suction manifold to the fluid end.

Manifold mounting yoke links 28 (FIGS. 7A and 7B) extend from the inboard side of opposed ends of the mounting plate 26 to spaced apart opposed manifold swivel arms 30. Links 28 ensure that the manifold plate 26 remains in alignment with the forging as will be described below.

A first end of each yoke link 28 is provided with appropriate fasteners 31 to secure each link to the plate 26. A second end of each link is provided with a hole to accept a pivot bolt 32 which pivotally attaches each link to a manifold swivel arm 30. Thus, during repair operation, when bolts 22 are removed from the mounting holes, the suction manifold 20 may be rotated about the pivot bolt 32 without the loss of the aligning relationship of the mounting holes in the plate with the holes in the forging. Links 28 allow the plate 26 to be rotated downwardly exposing the suction valves in the fluid end for inspection, repair or replacement.

Figure 2:
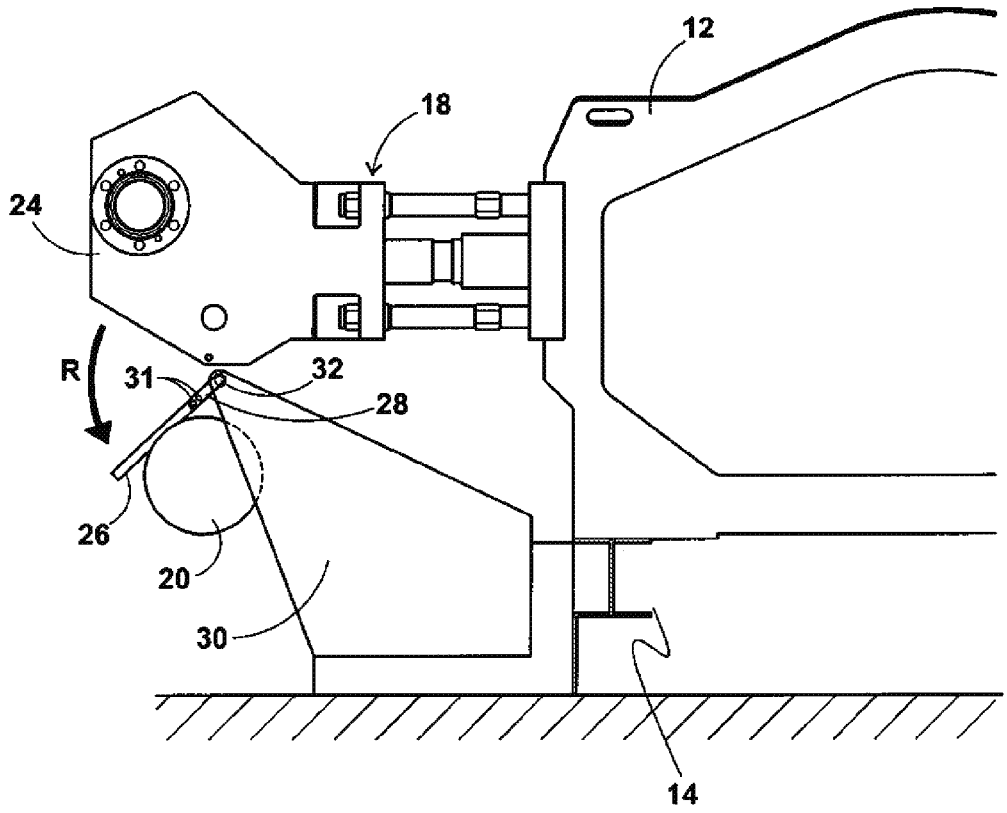
FIG. 2 is a left side elevation view of a high pressure pump showing an embodiment of the suction manifold mounting of FIG. 1 in the open position.

Manifold swivel arms 30 are securely affixed to the pump frame 14 supported on the trailer 16. FIGS. 1 and 2 show arm 30 welded to a frame support member 34 along weldment 36.

FIG. 2 illustrates the rotation of suction manifold 20 downwardly along path R away from the fluid end body forging 24. Thus, the suction valves of the pump are exposed for inspection, repair and/or replacement. It should be noted that links 28 retain plate 26 in position to ensure that the mounting holes in both the plate and the fluid end body forging will align when the manifold 20 is rotated back up along path R at the completion of suction valve maintenance.

Figure 3:
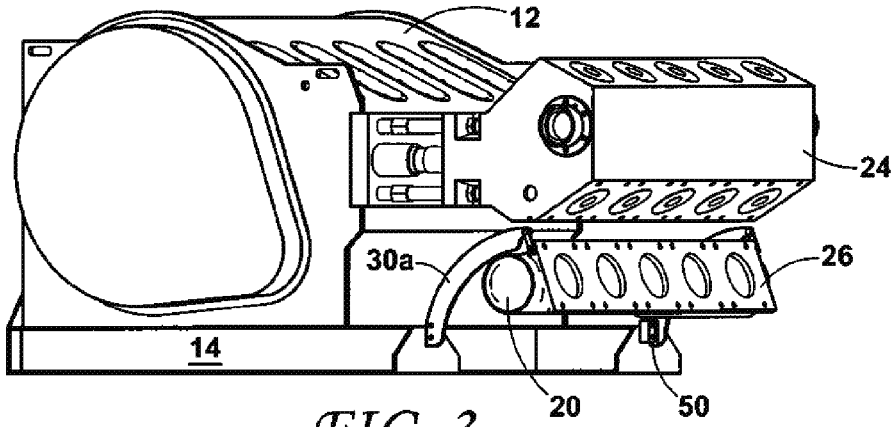
FIG. 3 is a right side perspective view of an embodiment of the suction manifold mounting system of the present invention in the open position.

Thus, it should be understood by one of ordinary skill in the art that the unique arrangement of the swivel arms 30, the pivot fasteners 32; the yoke links 28, and the manifold mounting plate 26 cooperate to ensure that the suction manifold 20 may be safely, quickly, and easily released from the body forging to expose the suction valves. FIG. 3 illustrates a perspective view of the suction manifold 20 in the open position. The swivel arms 30*a* of the embodiment of FIG. 3 are formed by plasma cutting ½ inch thick steel plate into an arcuate shape with two lower frame mounting holes and an upper pivot aperture.

Figure 6A:
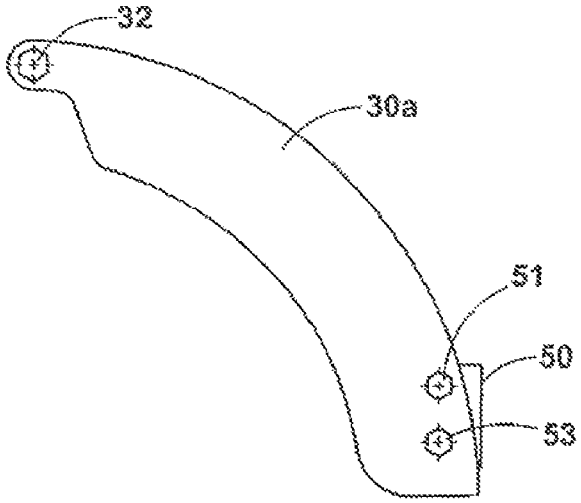
FIG. 6A is a side elevation view of the embodiment of the manifold swivel arm of FIG. 3.
Figure 6B:
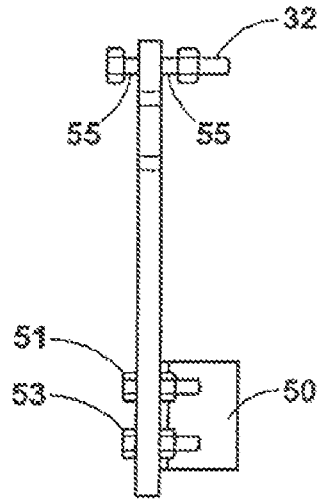
FIG. 6B is a front elevation view of a manifold swivel arm of the present invention.

FIGS. 6A and 6B show the detailed shape of the swivel arms 30*a* attached to a frame support bracket 50 by two fastener bolts 51 and 53 passing through the two lower frame mounting holes. A pivot bolt 32 extends through upper pivot aperture in arm 30*a*. As may be seen in FIG. 6B, there is space 55 between the opposed heads of bolt 32 to accept the spaced apart legs of the yoke links 28 as described below.

Figure 7A:
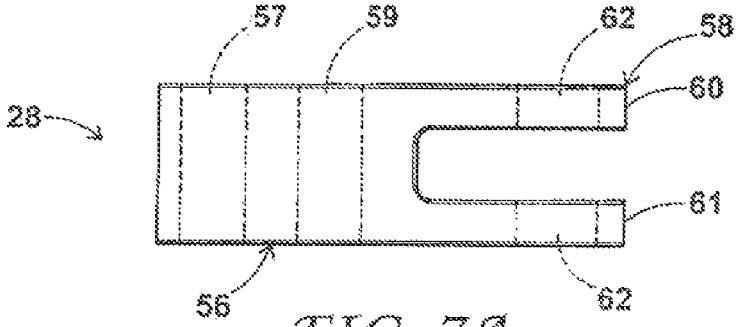
FIG. 7A illustrates a top plan view of the pivot link of the present invention.
Figure 7B:
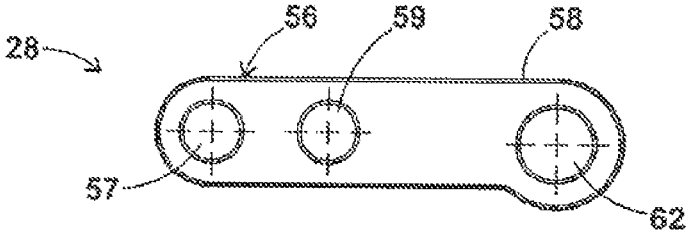
FIG. 7B shows a side elevation view of the pivot link of the present invention.

FIGS. 7A and 7B show the details of the manifold mounting yoke links 28. As previously indicated, a first end 56 of the link is provided with two fastener holes 57 and 59 for receiving appropriate fasteners 31 to secure the link to the manifold plate. The opposite end 58 of link 28 is provided with spaced apart legs 60 and 61 each having opposingly aligned pivot pin apertures 62.

It should be understood that when the upper end of swivel arm 30*a* is inserted between the spaced apart legs of the yoke and a pivot bolt 32 is slid through opposingly aligned pivot pin aperture 62 and through the upper pivot aperture in arm 30*a*, a pivot connection is formed between the link and the swivel arm. Legs 60 and 61 rotate or pivot in spaces 55 between the heads of the pivot bolt.

Because the first end of the yoke is securely fastened to the manifold plate 26 by fasteners 31, the manifold plate will rotate or pivot about the pivot bolt 32 from an open to a closed position.

Figure 4:
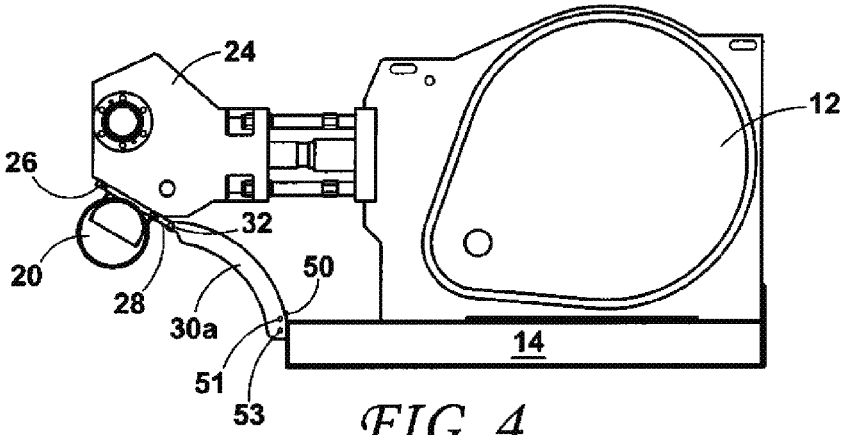
FIG. 4 is a left side elevation view of the embodiment of the suction manifold mounting system of FIG. 3 in the closed position.
Figure 5:
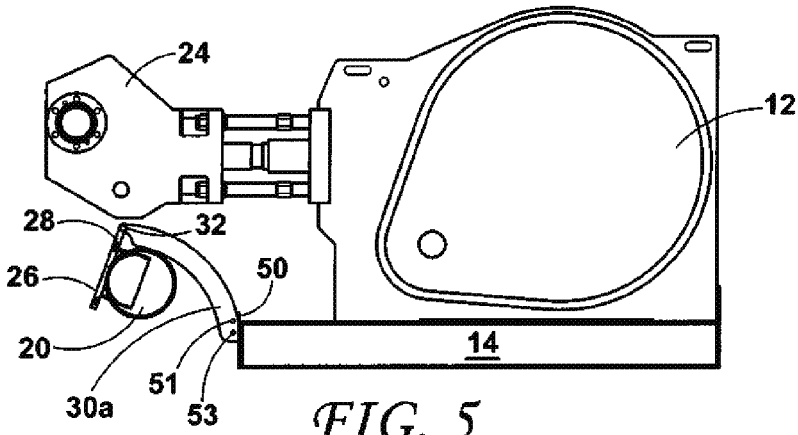
FIG. 5 is a left side elevation view of the embodiment of the suction manifold mounting system of FIG. 3 in the open position.

FIGS. 4 and 5 illustrate the embodiment of the arcuate swivel arm 30*a* in the open and closed positions, respectfully. A review of the discussion above regarding FIGS. 1 and 2 will make the embodiment of FIGS. 4 and 5 understandable. It should be noted that swivel arm 30*a* may be easily disconnected from the mounting bracket 50 and, thus, from the pump frame 14 in situations where the suction manifold must be moved to another location for whatever reason. While pivot bolt 54 could be removed to separate the manifold from the frame, this may not always be the quickest, safest or easiest way to accomplish this task.

Figure 8A:
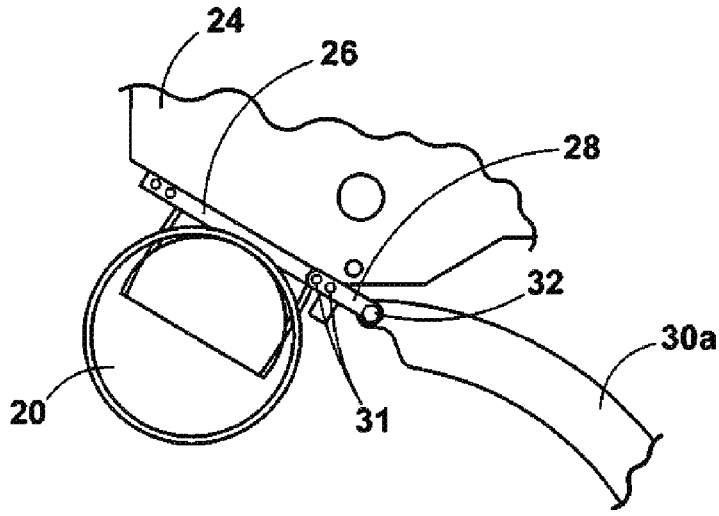
FIG. 8A illustrates an enlarged view of the pivot connection of the suction manifold mounting system of FIG. 4 (closed).
Figure 8B:
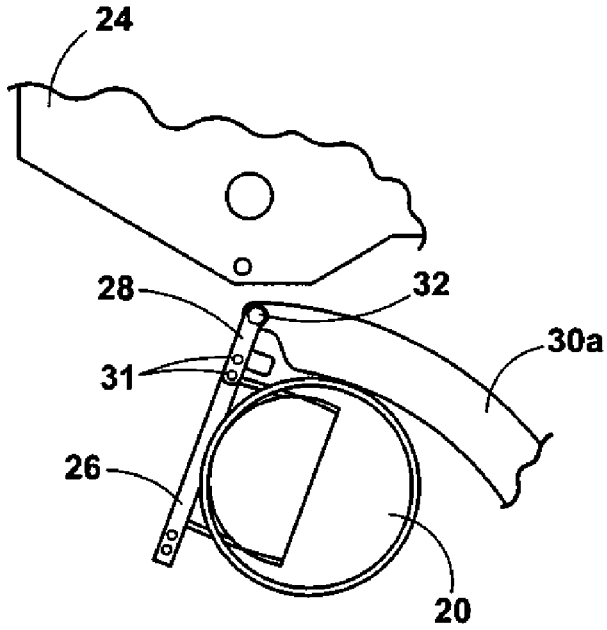
FIG. 8B shows an enlarged view of the pivot connection of the section manifold mounting system of FIG. 4 (open).

FIGS. 8*a* and 8B show an enlarged view of the operation of the pivot action of the manifold 20 about the pivot bolt 32. Link 28 connects the manifold plate 26 to the swivel arm 30*a* through the pivot connection at the pivot bolt 32.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

What I claim is:

1. A suction manifold for the fluid end of a high pressure pump comprising an elongated cylindrical tubular section, a manifold mounting plate attached to the cylindrical tubular section, and a pair of yoke links extending from opposed ends of the mounting plate, each yoke link comprises a first end having fastener holes and a second end provided with spaced apart legs, each leg having opposing aligned pivot pin apertures for rotably supporting the suction manifold.

2. A method of servicing a high pressure pump that includes a frame, a power end, a fluid end having a suction manifold including a manifold mounting plate removably secured to the fluid end by a plurality of bolts, and a plurality of suction intake valves located in the fluid end comprising:

removing the bolts that secure the manifold mounting plate to the fluid end;

rotatable supporting the manifold on a pair of support arms directly connected to the frame and mounting plate;

rotating the suction manifold about a fixed axis away from the fluid end thereby exposing the suction intake valves; and servicing the suction intake valves.

3. A high pressure pump comprising:

a frame;

a power end mounted on the frame;

a fluid end mounted on the frame and connected to the power end;

a detachable suction manifold plate mounted to the fluid end;

a pair of swivel arms mounted on the frame at one end and having holes at a second end;

a pair of yoke links mounted on the suction manifold plate and having holes therein; and a pair of pivot bolts extending through the holes in the second end of the swivel arms and the holes in the yoke links whereby the suction manifold plate is pivotably mounted on the frame so that it can be pivoted away from the fluid end.

4. A high pressure pump according to claim 3 wherein the inner diameter of the holes in the swivel arm and yoke links are substantially the same as the outer diameter of the pivot bolts so that the suction manifold plate rotates about a fixed axis.

5. A high pressure pump comprising:

a frame;

a power end mounted on the frame;

a fluid end mounted on the frame and connected to the power end;

a detachable suction manifold plate mounted to the fluid end;

said plate pivotably attached at opposed ends to a pair of opposed swivel arms through a cooperating pair of yoke links, said swivel arms attached to said frame; and each said yoke link comprises a first end having fastener holes and a second end provided with spaced apart legs each having opposing aligned pivot pin apertures.

6. A high pressure pump as claimed in claim 5 wherein each swivel arm comprises an arcurate plate portion.

7. A high pressure pump as claimed in claim 5 wherein a top portion of the swivel arms includes a pivot aperture and a threaded bolt having opposed heads, the spaced apart legs of the yoke link mounted between one of the opposed heads and the swivel arm.

* * * * *

UNITED STATES PATENT AND TRADEMARK OFFICE

CERTIFICATE OF CORRECTION

PATENT NO. : 8,105,055 B2
APPLICATION NO. : 12/487401
DATED : January 31, 2012
INVENTOR(S) : Tony M. Small It is certified that error appears in the above-identified patent and that said Letters Patent is hereby corrected as shown below:

On the Title page of the patent, item (73); the name of the Assignee reads "Fiac Tech Services, LLC, Cisco, TX (US)" should be changed to --Frac Tech Services, LLC, Cisco, TX (US)--

Signed and Sealed this
Twenty-second Day of May, 2012

David J. Kappos

David J. Kappos
*Director of the United States Patent and Trademark Office*